US006681779B2

(12) United States Patent
Stachowski

(10) Patent No.: US 6,681,779 B2
(45) Date of Patent: Jan. 27, 2004

(54) LAYERED CLIP

(76) Inventor: Barbara Stachowski, 11 El Gavilan, Orinda, CA (US) 94563

( * ) Notice: Subject to any disclaimer, the term of this patent is extended or adjusted under 35 U.S.C. 154(b) by 11 days.

(21) Appl. No.: 09/835,051

(22) Filed: Apr. 13, 2001

(65) Prior Publication Data

US 2003/0192565 A1 Oct. 16, 2003

(51) Int. Cl.[7] ..... A45D 8/26
(52) U.S. Cl. ..... 132/279; 132/273; 24/489
(58) Field of Search ..... 132/273, 275, 132/276, 277, 278, 279, 132, 133, 134; 24/543, 487, 489, 556, 3.13; 446/104, 116, 120, 122

(56) References Cited

U.S. PATENT DOCUMENTS

| | | | | | |
|---|---|---|---|---|---|
| 555,140 | A | * | 2/1896 | Wermann | 132/215 |
| 1,721,837 | A | * | 7/1929 | Schurger | 132/133 |
| 2,496,810 | A | * | 2/1950 | Nerrie | 434/160 |
| 3,590,830 | A | * | 7/1971 | Hannum | 132/278 |
| 3,595,249 | A | * | 7/1971 | Solomon | 132/279 |
| 3,860,014 | A | * | 1/1975 | Clifton | 132/278 |
| 5,154,196 | A | | 10/1992 | Moffat | 132/278 |
| 5,172,534 | A | * | 12/1992 | Milner et al. | 52/593 |
| 5,642,740 | A | * | 7/1997 | Chen | 132/277 |
| 5,833,335 | A | * | 11/1998 | Voughlohn | 132/273 |
| 5,862,814 | A | * | 1/1999 | Janik et al. | 132/275 |
| 6,003,522 | A | * | 12/1999 | Schach | 132/279 |
| 6,098,636 | A | * | 8/2000 | Curtiss et al. | 132/277 |
| 6,102,049 | A | * | 8/2000 | Chang | 132/273 |

FOREIGN PATENT DOCUMENTS

| | | | |
|---|---|---|---|
| FR | 40381 | 6/1932 | 16/3 |

* cited by examiner

*Primary Examiner*—Kevin Shaver
*Assistant Examiner*—David Comstock
(74) *Attorney, Agent, or Firm*—Haverstock & Owens LLP

(57) ABSTRACT

The device of the current invention is a multi-layer clip that is preferably configured for securing hair. The clip has at least three body sections and preferably four body sections. Body sections are configured to be coupled with adjacent body sections through hinges, whereby the body sections collectively open in a zig-zag fashion. Preferably, the clip is secured with the body sections in a layered and closed position through two-part snap features, wherein portions of the interlocking snap features are located on adjacent surfaces of adjacent body sections. Preferably, lengths of the body sections are sequentially altered such that body sections collectively close in a layered and cascaded fashion. Adjacent surfaces between adjacent body sections are preferably provided with protruding teeth structures to facilitate the securing of hair.

26 Claims, 8 Drawing Sheets

LAYERED CLIP

FIELD OF THE INVENTION

The invention relates to hair styling devices, systems and methods. More specifically, this invention relates to clips for securing and retaining a portion of hair.

BACKGROUND OF THE INVENTION

Hair styling often involves manipulating hair into a preferred orientation or style and securing the hair in that preferred orientation or style. Typical devices for performing this function include barrett devices and loop devices. Most of the prior art hair securing devices are configured to secure a single section of hair at a single location.

There are a number of hair styling device configured to clasp or secure a sections of hair in multiple locations. For example, Mondor in French document No. 608,630 describes a clip device with two clips that pivotally open in the same direction from a common surface of a fork shaped body section. Schach, in U.S. Pat. No. 6,003,522 describes a barrett with two displaced clasping members that are pivotally attached to open in opposite directions from a common surface of a body section. In the U.S. Pat. No. 5,154,196 issued to Moffat, Moffat describes a plurality of barrettes that are attached through strings, such that the barretts can clasp longitudinally to several positions on a strand of hair.

SUMMARY OF THE INVENTION

The current invention seeks to provide a device, a system and a method for securing multiple strands of hair in a stacked or layered fashion. Each body of the device is preferably elongated and substantially flat. Alternatively, body sections are curve or contoured, wherein each body is curve or contoured such that the adjacent body sections fit together in a folded manner. Preferably, body sections have differing lengths and are couple to close together in a closed position with body sections layered in a cascade fashion. The longest body section preferably has a length in a range of 4.0 to 10 cm and a width in a range of 0.5 to 3.0 cm. The body sections preferably have staggered widths such that the longest body section is also the widest body section. Alternatively, the body sections have the same widths and are all sufficiently wide to grasp and hold hair between adjacent surfaces of adjacent body sections.

Adjacent body sections of the clip are couple together through any suitable means including pole structures that pass through one or more body section, hinges, snap features or any combination thereof. Preferably, each body sections is pivotally coupled to a next adjacent body section or sections, such that the body sections collectively open in a zig-zag fashion. Preferably, the clip is secured in a layered and closed position through two-part snap features, whereby parts of the snap features are located on adjacent surfaces of adjacent body sections.

In accordance with the preferred embodiment of the instant invention, the clip has two outer body sections and two inner body sections. Each of the two outer body sections are pivotally attached to a first end of one of the two inner body sections and second opposite ends of the two inner body sections are pivotally attached to each other, whereby the body sections collectively close to secure three strands or sections of hair.

The clip is preferably configured to open in a zig-zag fashion and close in a layered and cascaded fashion, whereby sections are preferably pivotally attached to an adjacent body sections through pin hinges, snap hinges or living hinges. The clip is preferably held in the closed position through two-part ball and butterfly pressure snap features.

Clasping regions formed by adjacent surface of adjacent body sections of the clip are preferably provides with gripping elements or gripping structures to facilitate the ability of the device to hold sections of hair. The gripping structures or elements are non-slip pad formed from rubber or other resilient non-slip material. Preferably, the gripping elements or structures are teeth features protruding form selected surface of clasping regions.

In use, a first strand of hair is placed between a first and a second body section and secured; a second strand of hair is placed between the second body section and a third body section and secured; and a third strand of hair is placed between the third and a fourth body section and secured. Preferably, the strands of hair are secured in a layered and cascaded fashion.

BRIEF DESCRIPTION OF THE DRAWINGS

FIGS. 6*a–b* illustrate a clip with three contoured body sections coupled through living hinge elements in accordance with an alternative embodiment of the present invention.

DETAILED DESCRIPTION OF THE INVENTION

Figure 1A:
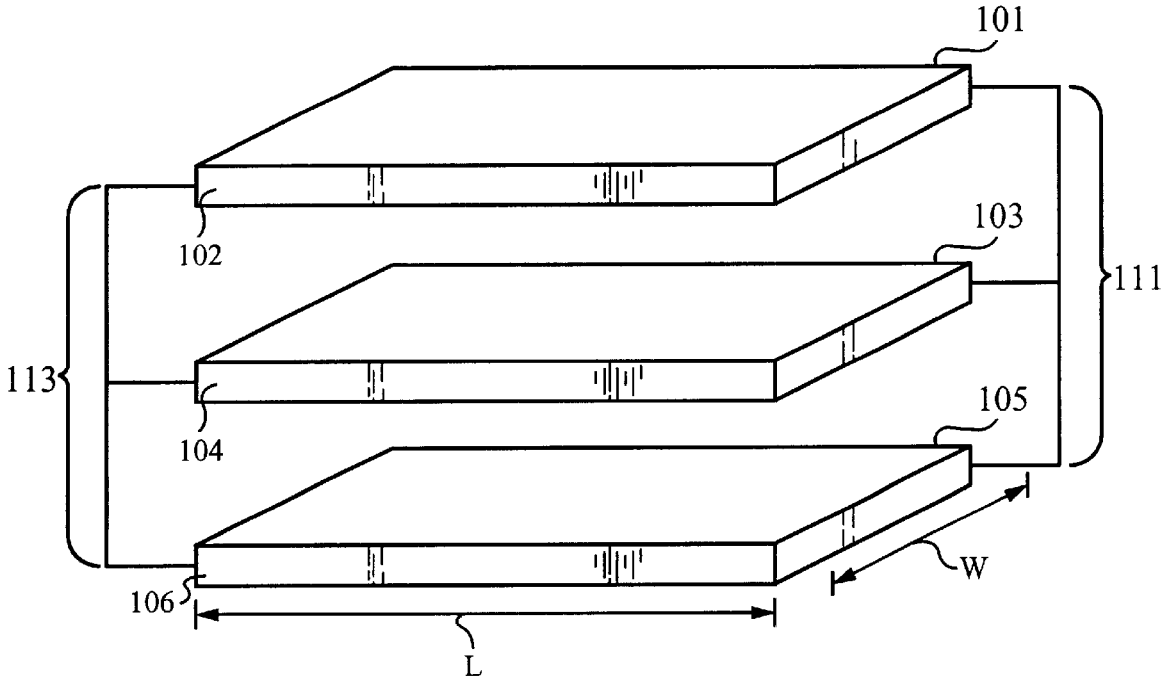
FIGS. 1*a–b* show three elongated body sections for securing sections or strands of hair therebetween.
Figure 1B:
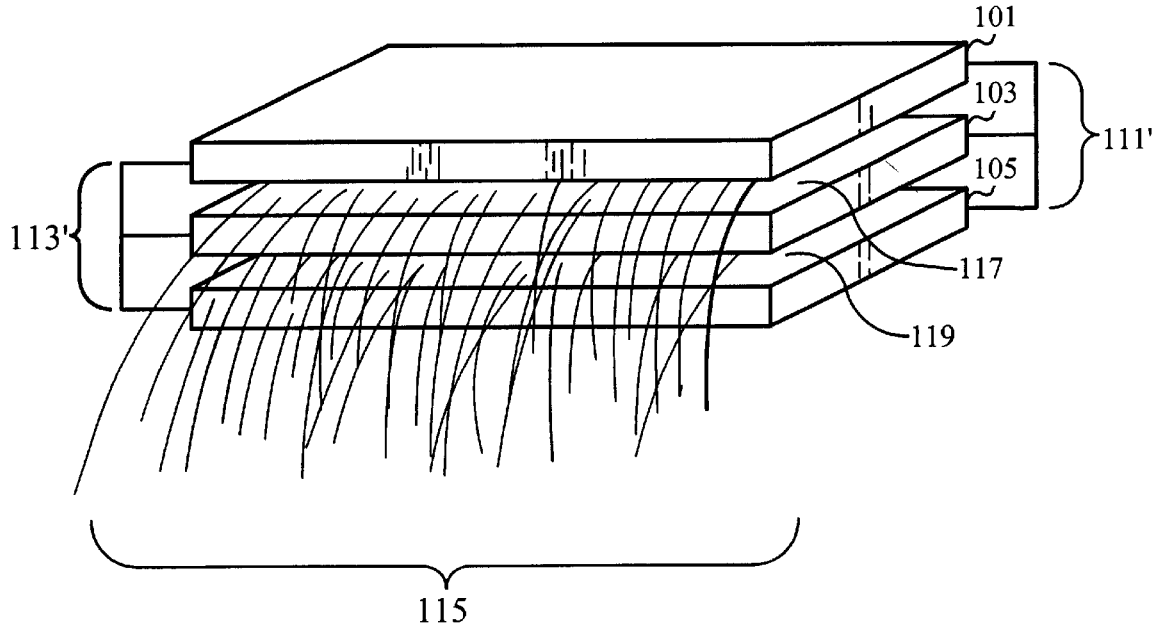
Figure 6B:
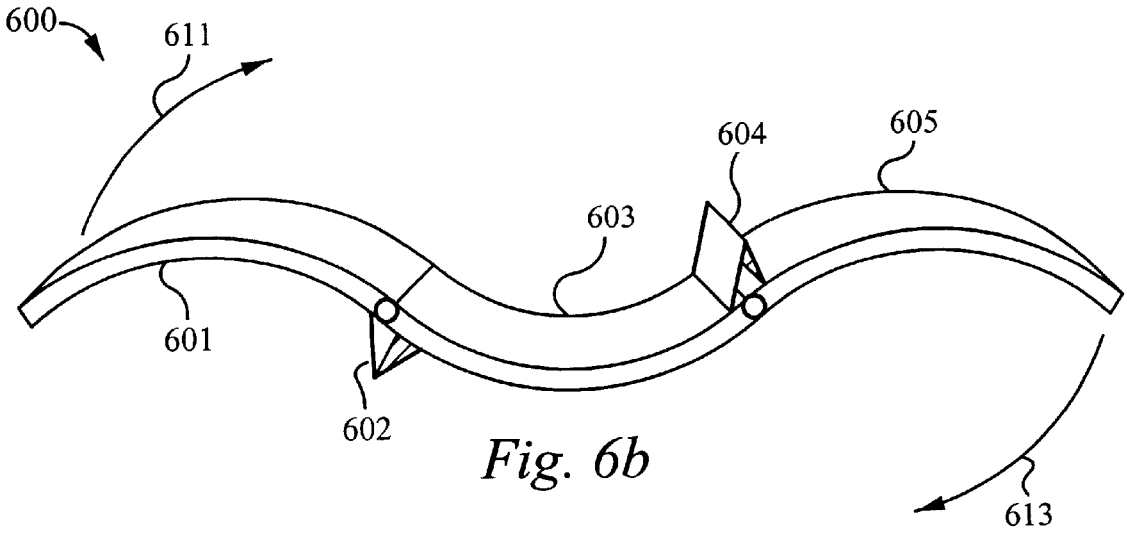
Figure 6B:
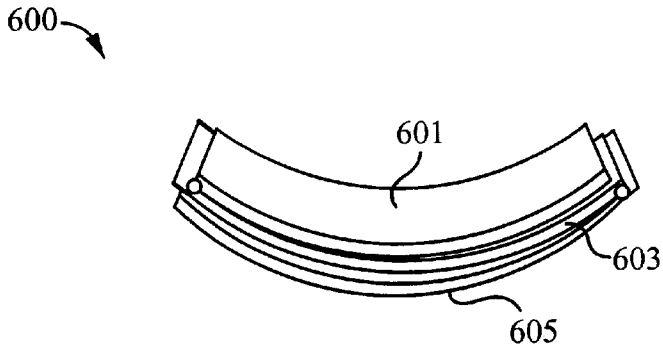

FIG. 1 illustrates three rectangular body sections 101, 103 and 105. Each body section 101, 103 and 105 is preferably elongated and substantially flat. However, the body sections 101, 103 and 105 can have any suitable shape and have patterned or contoured edges 102, 104 and 106. Alternatively, the body sections 101, 103 and 105 are curve or contoured, such as shown in FIGS. 6*a–b*. The body sections 101, 103 and 105 are preferably between 2.0 to 10 cm in length L and between 0.5 to 3.0 cm in width W. The body sections 101, 103 and 105 are formed from any suitable material including polymeric molded material, such as plastics, rubbers and the like, metals and combinations thereof. The body sections 101, 103 and 105 are capable of being separated by sets of ends 111 and 113.

In use, hair 115 is placed between the sections 101, 103 and 105 and the ends 111 and 113 place in a closed positions 111' and 113', whereby the hair 115 is securably held in the clasping regions 117 and 119 formed between the body sections 101, 103 and 105. The body sections 101, 103 and 105 are securable held in the closed position through any number of means including clips that fit over the one or more of the sets of ends 111 and 113, with the ends 111 and 113 in the closed positions 111 and 113'.

Figure 2A:
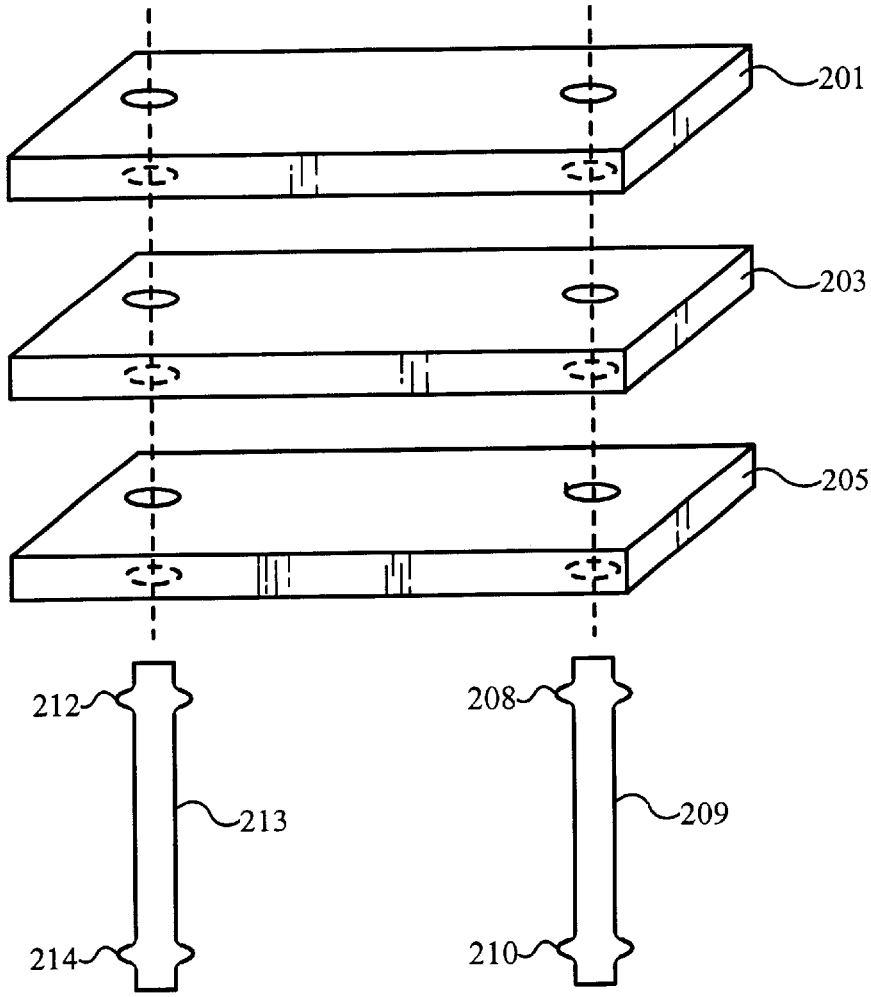
FIGS. 2*a–b* show three elongate body sections with pole shaped securing structures.
Figure 2B:
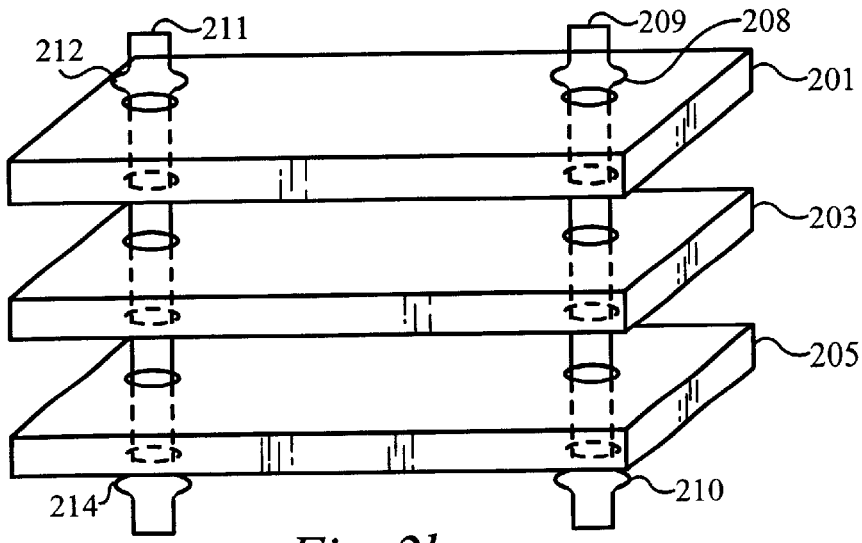

FIGS. 2*a–b* illustrate a clip in accordance with an embodiment of the current invention. The clip has at least three body sections 201, 203 and 205. Each of the body sections 201, 203 and 205 has one or more holes for receiving pole structures 209 and 213. Hair (not shown) is placed between the body sections 201, 203 and 205. The body sections 201, 203 and 205 are then placed in a closed a position and secured in the closed position by inserting the poles structures 209 and 211 through the holes, as shown in FIG. 2*b*. Preferably, each of the pole structures 209 and 213 has a sets of catch features 208/210 and 212/214 to prevent the pole structures 209 and 211 from slipping out of position once they are placed in the holes with the body sections 201, 203 and 205 and in the closed position.

Figure 3A:
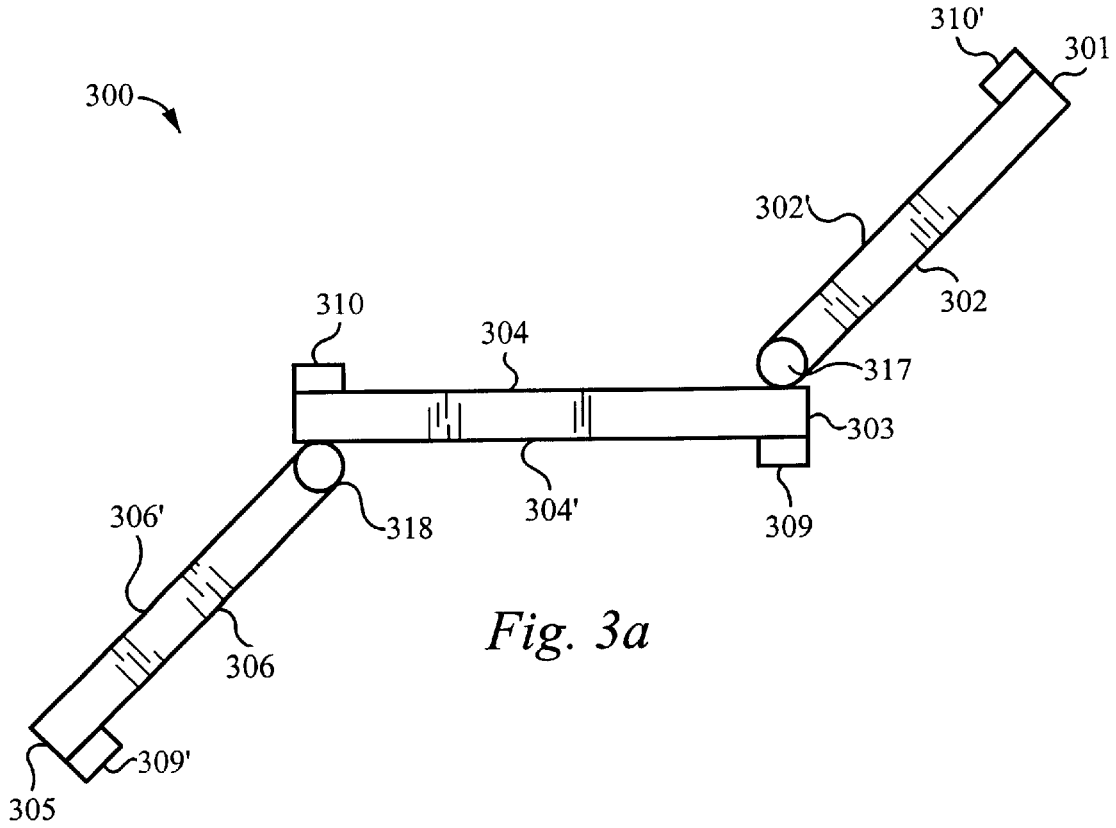
FIGS. 3*a–b* show a three body clip with two outer body sections hingably attached to opposite ends of the center body section and being securable in a closed position, in accordance with an embodiment of the current invention
Figure 3B:
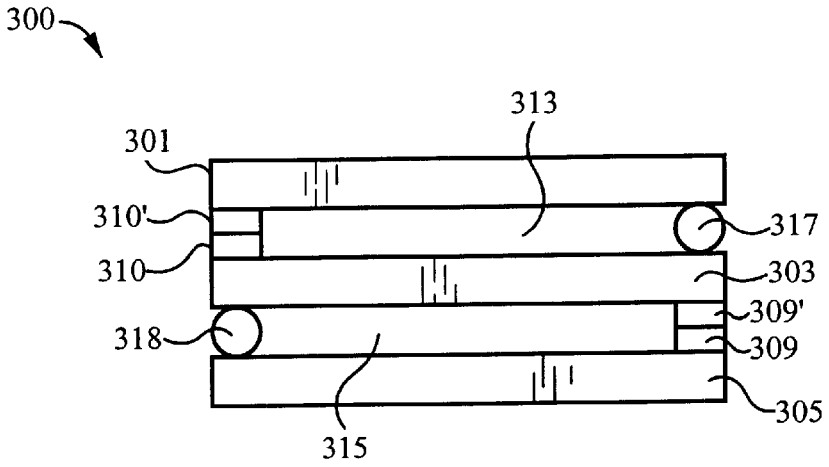

FIGS. 3*a–b* show a clip 300 in accordance with the current invention. As described previously, the clip has at least three body sections 301, 303 and 305. Each of the body sections 301, 303 and 305 has a top surface 302, 304 and 306 and a corresponding bottom surface 302', 304' and 306'. Adjacent body sections 301/303 and 303/305 are pivotally or hingably coupled through hinge elements 318 and 317. Preferably the outer body sections 301 and 305 are hingably coupled to the central body section 303 near or at opposed ends of the central body section 303.

Referring now to FIG. 3*b*, the clip 300 is capable of being placed in a closed and layered position by folding the body sections 301 and 305 over onto the central body section 303, as shown. The body sections 301, 303 and 305 are capable of being secured in the closed and layered position through securing features. The securing features are preferable two-part snap features 309/309' and 310/310, wherein first portions 309 and 310 of the two-part snap features are on the bottom 304' and the top surface 304 of the central body section 303 and, wherein second portions of the two-part snap features 309' and 310' are on the bottom surface 302 and the top surface 306 of the body sections 301 and 305, respectively. With the body sections 301, 303 and 305 secured in the closed and layered position, sections of hair (not shown) are held in the clasping regions 313 and 315 formed by adjacent surfaces 302'/304 and 304'/306 of the adjacent body sections 301/303 and 303/305.

Figure 4A:
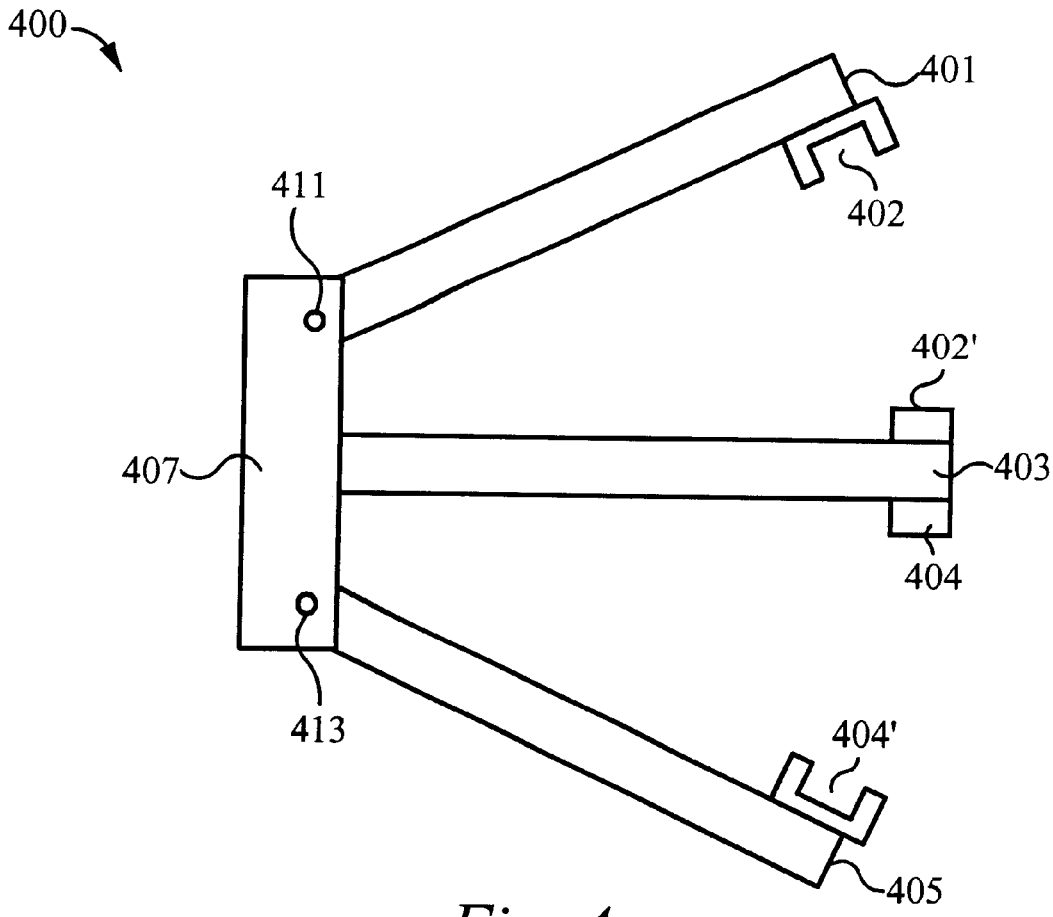
FIGS. 4*a–b* show a clip with three body sections coupled through a common end and being securable in a closed position, in accordance with an alternative embodiment of the current invention.
Figure 4B:
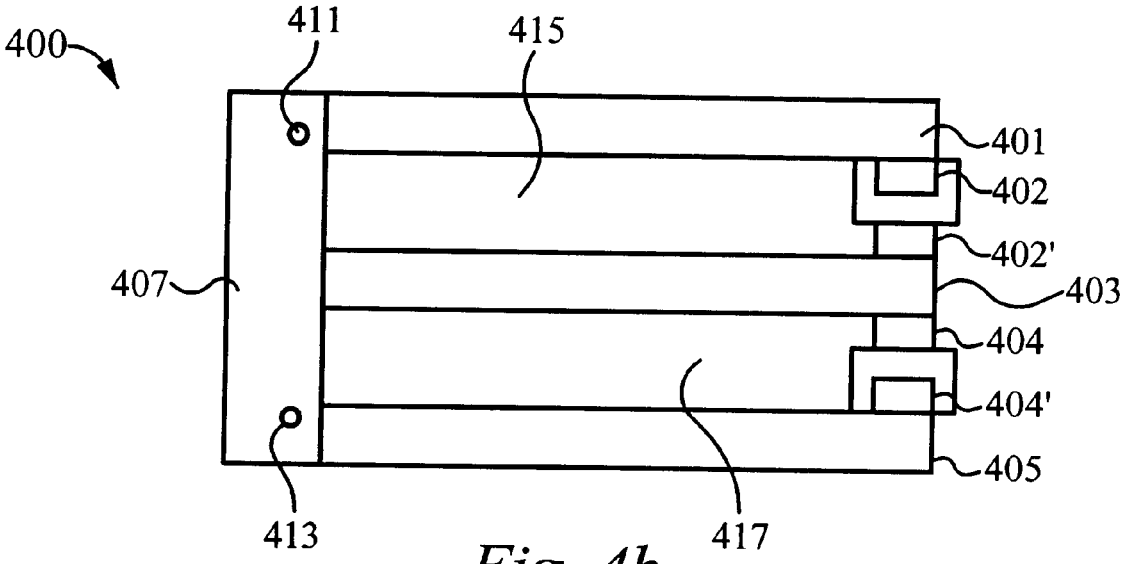

FIGS. 4*a–b* show a clip 400 in accordance with an alternative embodiment of the instant invention. The clip 400 has at least three body sections 401, 403 and 405 that are coupled through a common end section 407. The outside body sections 401 and 405 are preferably hingably coupled to the end section 407 through hinge elements 411 and 413. The central body section 403 is either securably fixed to the end section 407 or is configured to detach or otherwise move from the fixed position shown in FIGS. 4*a–b*.

Referring now to FIG. 4*b*, the clip 400 is capable of being placed in a closed position and forming the clasping regions 415 and 417 between adjacent surface of adjacent body sections, as described above. The sections 401, 403 and 405 are preferably held in the closed position through two sets of two-part snap features 402/402' and 404/404' also previously described.

Figure 5A:
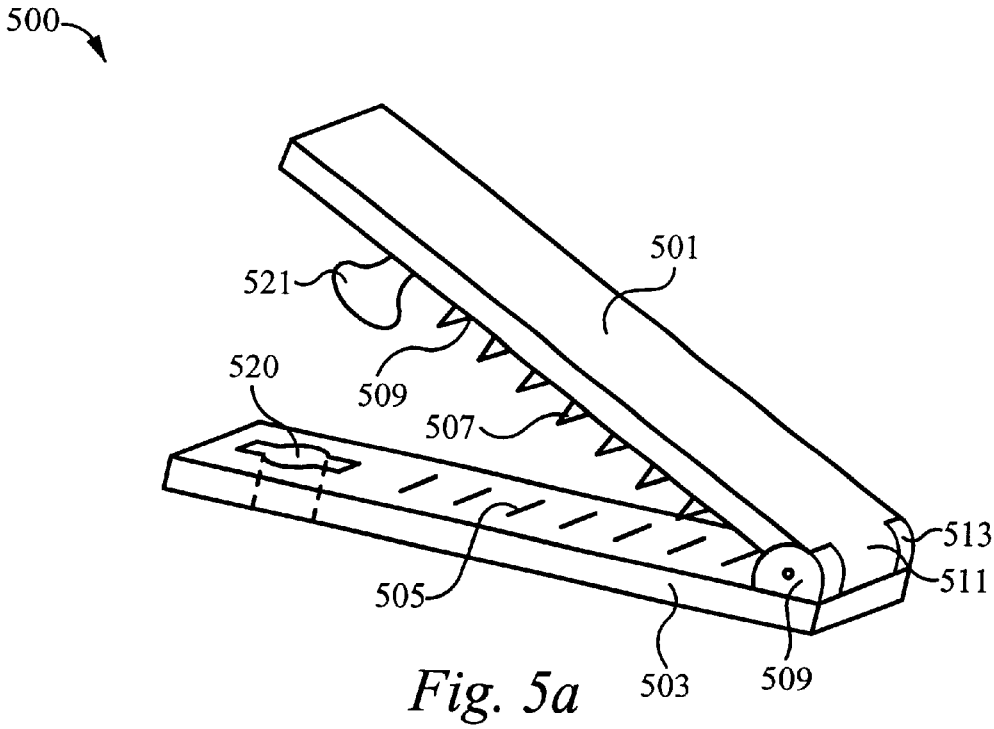
FIGS. 5*a–b* illustrate two-part ball and butterfly snap features used to secure clip sections in a closed position, in accordance with a preferred embodiment of the current invention.
Figure 5B:
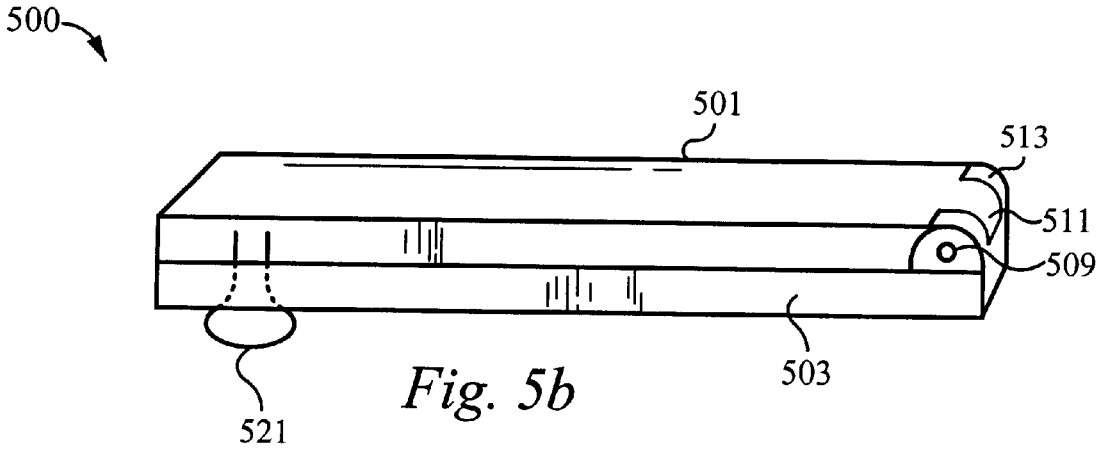

FIGS. 5*a–b* illustrate a section 500 of the clip device in accordance with a preferred embodiment of the instance invention. Adjacent body sections 501 and 505 are hingably attached through a hinge element. The hinge element is a pin hinge element, a snap hinge feature or a living hinge. Preferably, the hinge element has is a pin hinge. The pin hinge element is formed from interlocking portions 511 and 513 of the body sections 501 and 503 and a hinge pin 509 which passing through the interlocking portions 511 and 513. The adjacent surfaces 505 and 509 of the adjacent body section 503 and 501 are configured in any number of ways to facilitate securing hair. For example, the surface 509 is provided with a plurality of protruding teeth features 507 that help to hold and secure hair between the surfaces 505 and 509 with the sections 500 in the closed position, as shown in FIG. 5*b*. The surface 505 is smother or contoured with raised or lowered features. Alternatively, one or both of the adjacent surfaces 505 and 509 of the section 500 is provided with a non-slip pad formed from rubber or any other resilient non-slip material that helps to hold and secure hair between the surfaces 505 and 509 with the sections 500 in the closed position, as shown in FIG. 5*b*.

In use, a selected strand or section hair (not shown) is placed between the sections 501 and 503. The section 501 and 503 are place in the closed position as shown in FIG. 5*b* with the hair between the body section 501 and 503. The body sections 501 and 503 are then secured in the closed position through a two-part snap feature 520/521. The two-part snap feature has ball structure 521 protruding from the surface 509 and a butterfly receptacle 520 on the surface 505. The ball structure 521 is placed into the butterfly receptacle 520 and a sufficient pressure applied to the body sections 501 and 503, such that the two-part snap features 520/521 assume an interlocking and secured position.

FIGS. 6*a–b* illustrate a clip 600 with curved body sections 601, 603 and 605. The body sections 601, 603 and 605 are coupled together through living hinge structures 602 and 604. The living hinge structures 602 and 604 allow the body sections 601, 603 and 605 to fold over in the directions 611 and 613 and to assume the closed position shown in FIG. 6*b*. The living hinge structure 602 and 604 fold over and snap into a closed position when the body sections 601, 603 and 605 are place in the closed position. Thus the hinge elements 602 and 604 not only couple the body sections 601, 603, and 605 together, but they also secure the body sections 601, 603 and 605 in the closed position. It will be clear to one of ordinary skill in the art that the clip 600 is alternatively configured with two-part snap features or any other securing means to hold the body sections 601, 603 and 605 in the closed position.

Figure 7A:
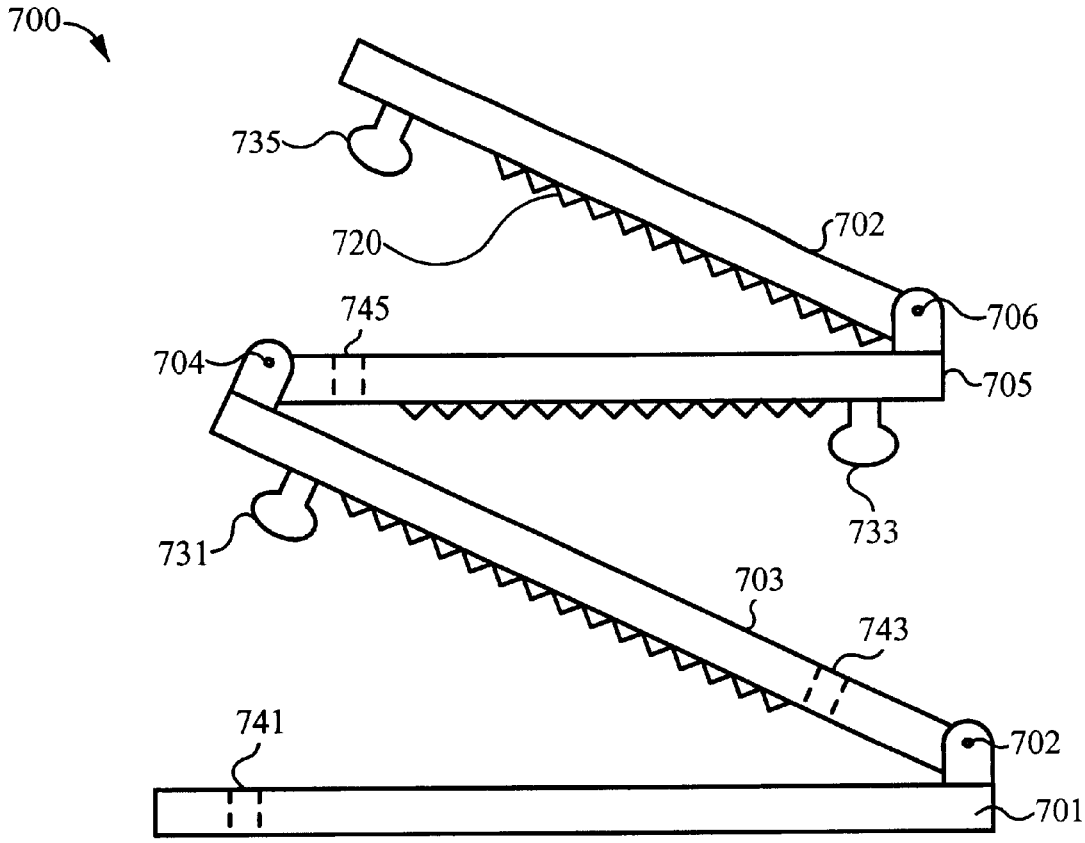
FIGS. 7*a–c* illustrate a multi-layer hair clip with four body sections that open in a zig-zag fashion and closed in a cascaded and layered fashion, in accordance with the preferred embodiment of the current invention.
Figure 7B:
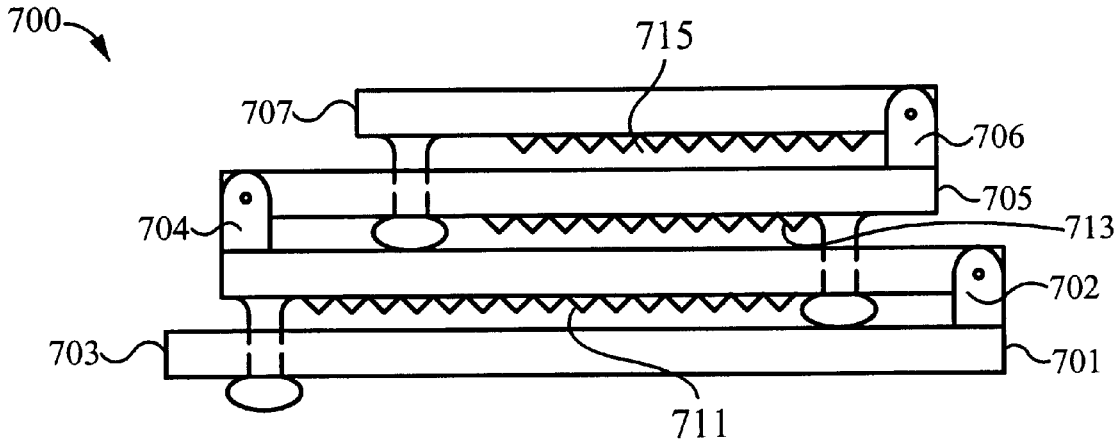
Figure 7C:
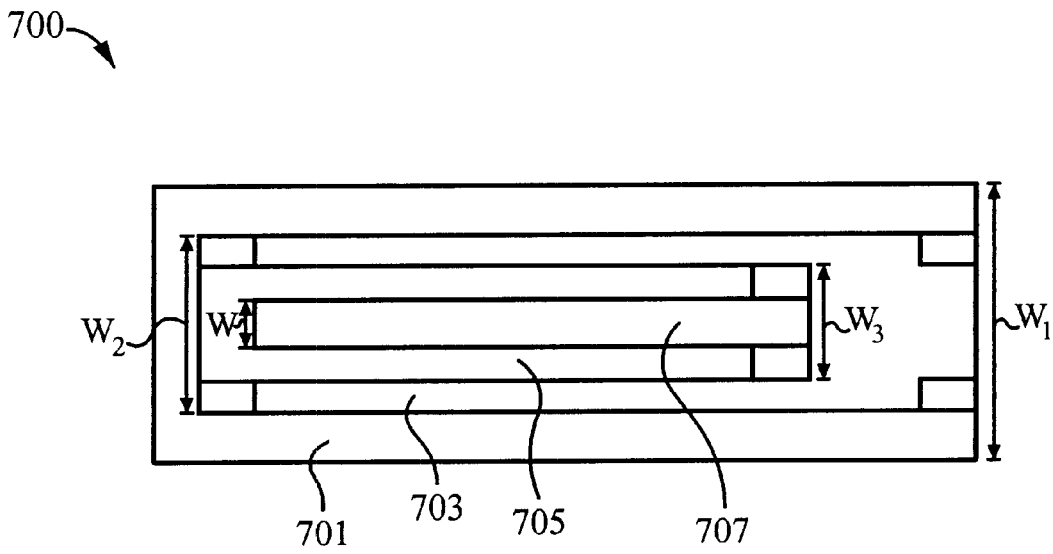

FIGS. 7*a–c* illustrate a layered hair clip 700 in accordance with the preferred embodiment of the current invention. The layered hair clip 700 has four body sections 701, 703, 705 and 707. Preferably, the body sections 701, 703, 705 and 707 have differing lengths with each section 701, 703, 705 and 707 being sequentially shorter. The body sections 701, 703, 705 and 707 are preferably coupled through hinges 702, 704 and 706, such that the body sections 701, 703, 705 and 707 collectively open in a zig-zag fashion, as shown in FIG. 7*a*, and close in a layered and cascaded fashion shown in FIG. 7*b*. The longest body section 701 is preferably in a range of 4.0 and 10 cm long. Preferably, the body sections 701, 703, 705 and 707 are secured in the closed position through two-part ball and butterfly snap features such as previously described above. Selected surfaces of the layered hair clip 700 are provided with protruding teeth features 720, 730 and 740 to help securing sections or strands of hair (not shown) in the clasping regions 711, 713 and 715, with the multi-layered hair clip 700 in the closed position.

Referring to FIG. 7*c*, the body sections 701, 703, 705 and 707 preferably have different widths with each section 701, 703, 705 and 707 being sequently or progressively thinner $W_1$, $W_2$, $W_3$ and $W_4$, such that the longest body section 701 is the widest $W_1$ body section and the shortest body section 707 is the thinnest $W_4$.

Still referring to FIGS. 7*a–c*, in use a first strand of hair is placed between the first 701 and the second body section 703. The first strand of hair is secured between the first 701 and the second body section 703 in a closed position by interconnecting the ball 731 and the butterfly 741 snap feature. A second strand of hair is placed between the second 703 and the third body section 705. The second strand of hair is secured between the second 703 and the third body section 705 in the closed position by interconnecting the two-part the ball 733 and butterfly 743 snap feature. A third strand of hair is placed between the third 705 and the fourth body section 707. The third strand of hair is secure between the third 705 and a fourth body section 707 in the closed position by interconnecting the ball 735 and the butterfly 745 snap feature. Accordingly, the first, second and third strand of hair are secured together through the multi-layered hair clip 700, with the strands or sections of hair forming a layered and cascaded arrangement.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiments chosen for illustration without departing from the spirit and scope of the invention. Therefore, it is understood that the present invention could be implemented in several different ways and have several different appearances.

What is claimed is:

1. A clip comprising:

a. three or more elongated body sections hingably attached to each other through hinge elements in a zig-zag fashion; and b. means for coupling the three or more body sections together in a layered and directly overlapping configuration for clasping two or more strands of hair, wherein the means for coupling comprises snap features.

2. The clip of claim 1, wherein the three or more body sections are between 2.0 and 10.0 cm in length and are staggered in length such that the three or more body sections couple in a layered and cascaded fashion in the elongated direction.

3. The clip of claim 2, wherein the body sections are between 0.5 and 2.0 cm in width and wherein the widths are staggered such that the longest of the three or more body sections is the widest and the shortest of the three or more body sections is the thinnest.

4. The clip of claim 1, wherein the means for coupling the three or more body sections together comprise hinges sections and clip sections.

5. A multi-layer clip comprising a first elongated body section, a second elongated body section, a third elongated body section, each of the first, second, and third elongated body sections with a top and a bottom surface and configured to securably close through snap features in a layered and directly overlapping fashion to form a first and a second layered and directly overlapping clasping region, wherein the first clasping region is formed by the top surface of the first elongated body section and the bottom surface of the second elongated body section, the second clasping region is formed by the top surface of the second elongated body section and the bottom surface of the third elongated body section, and wherein the first and the third elongated body sections are hingably attached near opposite ends of the second elongated body section to open in zig-zag fashion through hinge elements.

6. The multi-layer clip of claim 5, wherein the first, the second and the third elongated body sections are securably coupled through at least one fastener.

7. The multi-layer clip of claim 5, wherein the snap features are two part snap features.

8. The multi-layer clip of claim 7, wherein the two part snap features comprise a ball structure and a butterfly receptacle, wherein the ball structure inserts into the butterfly receptacle.

9. The multi-layer clip of claim 5, wherein the first elongated body section is longer than the second elongated body section and, wherein the third elongated body section is longer than the second elongated body section.

10. The multi-layer clip of claim 9, wherein the first elongated body section has a length in the range of 4.0 to 10 cm and a width in a range of 0.5 to 3.0 cm.

11. The multi-layer clip of claim 5, wherein at least one of the two clasping regions comprises a gripping element for securing hair.

12. The multi-layer clip of claim 11, wherein the gripping element is selected from the group consisting of a non-slip rubber pad and protruding teeth features.

13. The multi-layer clip of claim 5, further comprising a fourth elongated body section with a top surface and a bottom surface and configured to securably couple through snap features to the third elongated body section and form a third clasping region.

14. The multi-layer clip of claim 13, wherein a first end of the first elongated body section and first end of the third elongated body section are hingably attached near opposite ends of the second elongated body section and wherein the fourth elongated body section is hingably attached near a second end of the third elongated body section, such that the multi-layer clip opens in a zig-zag like fashion.

15. The multi-layer clip of claim 13, wherein the first, the second, the third and the fourth elongated body sections are progressively shorter, such that the clip closes to form the first, the second and the third clasping regions in a cascade like fashion.

16. The multi-layer clip of claim 13, wherein the fourth elongated body section is held in a closed position through a ball snap feature protruding from the bottom surface of the fourth elongated body section which snaps into a receiving butterfly snap feature through the top surface of the third elongated body section.

17. The multi-layer clip of claim 13, wherein the first, the second, the third and the fourth elongated body sections are substantially flat.

18. A hair clip comprising two outer body sections and two inner body sections, each of the two outer body sections being hingably attached to a first end of each of the two inner body sections and the second ends of the two inner body sections being hingably attached to each other through hinge elements, such that the two inner body sections and the two outer body sections collectively close through snap features in a layered and directly overlapping configuration forming three clasping sections for receiving hair and open in a zig-zag configuration.

19. The hair clip of claim 18, wherein each of the two outer body sections are hingably attached to the first end of each of the two inner body sections and the second ends of the two inner body sections are hingably attached to each other, through hinge elements selected from the group consisting of pin hinges, snap hinges and living hinges.

20. The hair clip of claim 18, wherein one of the two outer body sections is the longest body section and one of the two outer body sections is the shortest body section and the two inner body sections have lengths that are intermediate to the two outer body sections, wherein the two outer body sections and the two inner body sections collectively close in the closed position with the two outer body sections and the two inner body sections layered and cascaded.

21. The hair clip of claim 20, wherein the longest of the two outer body sections has a length in the range of 4.0 to 10.0 cm and a width in a range of 0.5 to 3.0 cm.

22. The hair clip of claim 20, further comprising securing elements for securing the hair clip in the closed position.

23. The hair clip of claim 22, wherein the securing elements comprise two-part snap features.

24. The hair clip of claim 18, wherein at least one of the body sections comprises gripping teeth.

25. A method of making a hair clip comprising:

a. forming a first, second and third elongated body section; and b. hingably coupling the first and the third body section to opposite ends of the second body section such that the first, second and third body section closed in a directly overlapping and layered fashion and open in zig-zag fashion.

26. The method of claim 25, wherein in the first, second and third body sections are formed with interconnecting snap features to hold the first, second and third body sections in a closed position for clasping hair between the first and the second body sections and between the second and the third body sections.

* * * * *